US005444952A

United States Patent [19]

Jackson

[11] Patent Number: 5,444,952

[45] Date of Patent: Aug. 29, 1995

[54] CHIMNEY REINFORCING DEVICE

[76] Inventor: Paul R. Jackson, 4020 S. Lindsey Ave., Pico Rivera, Calif. 90660

[21] Appl. No.: 353,683

[22] Filed: Dec. 12, 1994

[51] Int. Cl.[6] ..... E04C 5/00

[52] U.S. Cl. ..... 52/219; 52/244; 52/167.1; 52/514; 52/741.3; 52/721.5

[58] Field of Search ..... 52/219, 244, 167.1, 52/223.3, 741.3, 745.17, 725, 514; 248/345.1, 218.4

[56] References Cited

U.S. PATENT DOCUMENTS

| | | | |
|---|---|---|---|
| 385,489 | 7/1888 | Van Gaasbeek | 52/244 |
| 726,160 | 4/1903 | Harden | 52/244 |
| 3,148,773 | 9/1964 | Baumer | 206/322 |
| 3,815,733 | 6/1974 | Roberts | 52/244 X |

*Primary Examiner*—Carl D. Friedman
*Assistant Examiner*—Robert J. Canfield

[57] ABSTRACT

A chimney reinforcing device for increasing the resistance of a brick chimney to destruction during an earthquake. The chimney to be reinforced is of the type which extends above the roof line and which is built between two vertical studs within a wall. The chimney is reinforced by two shorter lengths of angle iron extending from near the top of the chimney to near the roof line and two longer lengths of angle iron which extend on the exterior corners of the chimney below the roof line. These four angle irons are tied together by one or more cables. The two longer lengths of angle iron are secured to the vertical studs providing a chimney top which is supported by the lower portion of the chimney and which is less likely to be destroyed in an earthquake.

7 Claims, 1 Drawing Sheet

CHIMNEY REINFORCING DEVICE

BACKGROUND OF THE INVENTION

The field of the invention is earthquake reinforcing devices and the invention is directed more particularly to reducing the chance of a brick chimney toppling during an earthquake.

It is well known that a major damage to residential structures during an earthquake is caused by the toppling of the top portion of unreinforced brick chimneys. Such chimneys are commonly present in older houses. While brick has a high degree of strength in compression, the bond between the brick and mortar is not particularly strong so that the during an earthquake which typically involves a side to side movement, such chimneys typically break at the roof line and the bricks and upper portion of the chimney fall and can cause serious damage to property and to humans who might be in the vicinity. In most earthquakes the lower portion of the chimney which is supported in the wall of the structure does not fall and only the unsupported portion above the roof line is affected.

A device for protecting the top of a chimney is shown in U.S. Pat. No. 726,160. A construction unit assembly is shown in U.S. Pat. No. 3,815,733. Neither of these patents are directed to earthquake preparedness.

SUMMARY OF THE INVENTION

It is an object of the present invention to reinforce brick chimneys which extend above the roof line of a structure.

The present invention is for a chimney reinforcing device for increasing the resistance of a brick chimney to destruction during an earthquake. The chimney to be reinforced is of the type which is constructed between vertical studs within the wall of a structure. The chimney extends outwardly from the wall and upwardly past a roof. The chimney has two external corners and two internal corners which intersect the roof. The reinforcing device comprises two longer lengths of angle iron which extend over the two external corners a distance at least two feet below the lowest point of intersection of the chimney with the roof line. Two shorter lengths of angle iron extend from near the top of the chimney to near the point of intersection with the roof. At least one upper cable is tightened around the four lengths of angle iron and at least one lower cable is secured to the two vertical studs and tightened around the two longer lengths of angle iron. The result is that the upper portion of the chimney is held together and supported by the lower portion of the chimney and is far less likely to topple during an earthquake. The present invention is also for the method of reinforcing the chimney comprising the steps of placing two shorter lengths of angle iron around the internal corners of the chimney and two longer lengths of angle iron around the two external corners and tightening the four lengths of angle iron above the roof line and tightening the two longer lengths of angle iron to the vertical studs adjacent the chimney.

DESCRIPTION OF THE PREFERRED EMBODIMENTS

Figure 1:
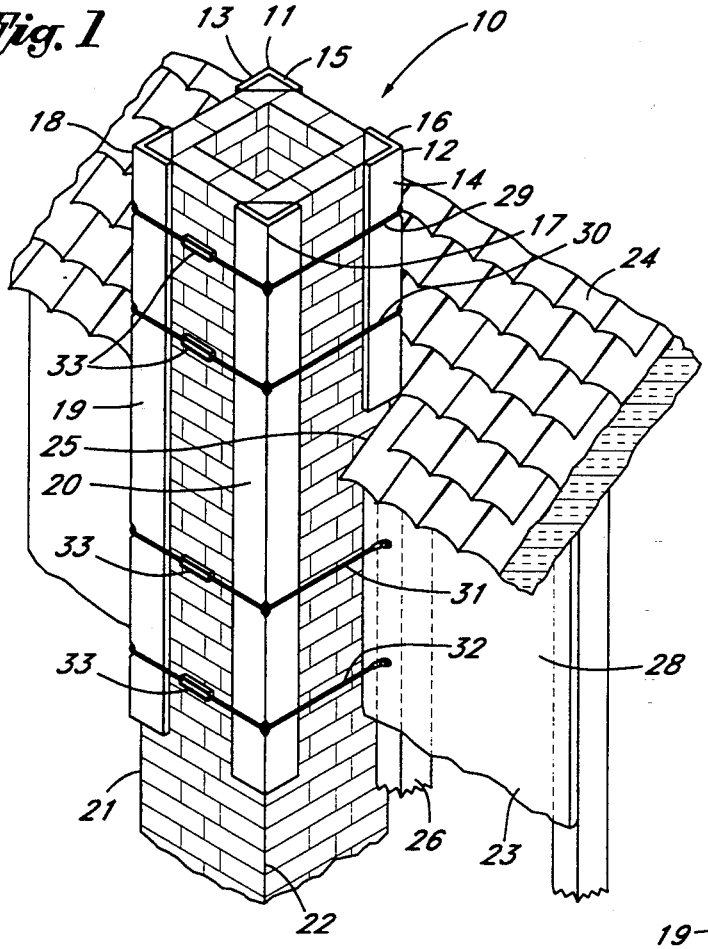
FIG. 1 is a perspective view of a chimney reinforced with the reinforcing device of the present invention.

A reinforced chimney is shown in perspective view in FIG. 1 and indicated generally by reference character 10. Chimney 10 has two internal corners which are hidden beneath two shorter lengths of angle iron. The two internal corners are indicated by reference characters 11 and 12 and the two shorter lengths of angle iron are indicated by reference characters 13 and 14. The chimney has four top corners 15, 16, 17 and 18. The chimney is reinforced both by the shorter lengths of angle iron 13 and 14 and two longer lengths of angle iron 19 and 20. These longer lengths surround the two external corners 21 and 22.

Chimney 10 is built within a wall 23 which has a roof 24 which intersects the chimney at a line of intersection 25. The chimney is built between two vertical studs 26 and 27 shown best in FIG. 2 and, at least typically in California, the wall is covered by a layer of stucco 28.

The four lengths of angle iron 13, 14, 19 and 20 are held together by two upper cables 29 and 30 and two lower cables 31 and 32. Lower cables 31 and 32 are secured to vertical studs 26 and 27 by any conventional method preferably utilizing lag bolts which securely hold the cables to the studs. Four turnbuckles 33 are used to tighten the cables around the chimney in a conventional manner.

Figure 3:
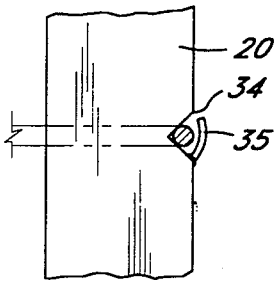
FIG. 3 is an enlarged side view of one of the angle irons used in the chimney reinforcing device of FIG. 1.
Figure 4:
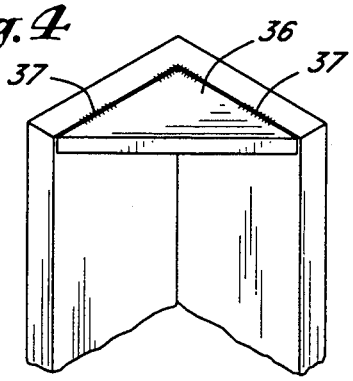
FIG. 4 is an enlarged perspective view of the top end of one of the angle irons of the reinforcing device of FIG. 1.

Preferably the angle irons include some sort of device for holding the cable to the angle iron during installation. One such method is shown in FIG. 3 where angle iron 20 has a notch 34 and a finger 35 welded at the base of the notch to hold the cable in place during installation. Also preferably the irons have a top plate 36 shown best in FIG. 4 which can be placed over the top corners 15, 16, 17 and 18 as shown in FIG. 1. This top plate is tack welded at 37 so that it may be knocked off if not needed.

Figure 2:
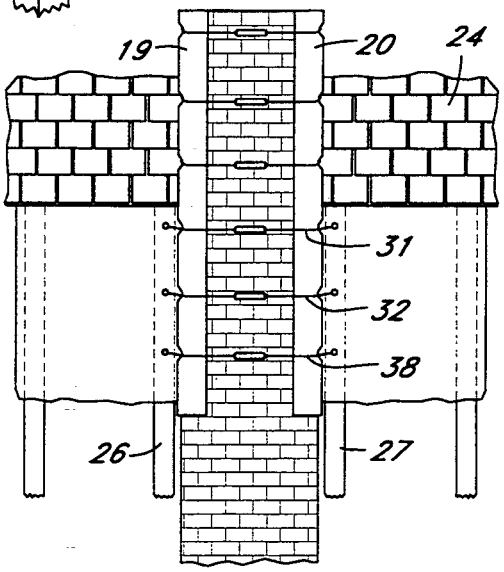
FIG. 2 is a front view of the chimney and a portion of the structure of FIG. 1.

The two shorter lengths of angle iron 13 and 14 preferably should extend either from the top or near the top of the chimney to the line of intersection 25. The longer lengths 19 and 20 extend from near the top of the chimney to a distance of at least two feet and preferably four to six feet below the line of intersection. In this manner it may be tied to the vertical studs 26 and 27 in a very secure manner by two cables 31 and 32 or three cables 31, 32 and 38 as shown in FIG. 2.

During an earthquake the longer lengths of angle iron are held by a significant length of the chimney which is below the line of intersection with roof 24. This part of the chimney is supported between the two vertical studs as well as by the stucco wall 28. It, therefore, is much stronger than the unsupported portion of the chimney which extends above the roof line. This unsupported part, however, is now tied in with the lower length of the chimney by the upper cables and angle irons and, therefore, the entire chimney is made into one secure unit much less likely to topple.

The angle iron should be relatively strong construction such as ¼" steel and is preferably galvanized or otherwise protected against the elements. It may be painted a color to match the chimney. It may further be easily used over existing chimneys which were built at a time before earthquake codes were in existence. Typically, the longer lengths of angle iron would be between six and eight feet in length and the shorter lengths of angle iron would be three to five feet in length. Both angle irons would be between two and three inches wide on each side. The cables are preferably stranded cables. The chimney reinforcing device of the present invention can be economically fabricated and installed and will provide an important safety device for older houses.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A chimney and reinforcing device in combination for increasing the resistance of a brick chimney to destruction during an earthquake, the chimney to be reinforced being of the type which is constructed between vertical studs within a wall, said chimney extending outwardly from the wall past a roof, the chimney having two external corners and two internal corners which intersect the roof, and the chimney having four top corners, the reinforcing device comprising:

two longer lengths of angle iron extending over the two external corners from near two of the top corners downwardly to a distance of at least two feet below the lowest point of intersection of the chimney with the roof line;

two shorter lengths of angle iron extending over the two internal corners from near two of the top corners to near the intersection of the chimney with the roof; and at least one upper cable surrounding the four lengths of angle iron, said cable including tightening means; and at least one lower cable surrounding the two longer lengths of angle iron, said lower cable being secured to the vertical studs between which the chimney is constructed, whereby the chimney is protected against damage during an earthquake.

2. The chimney reinforcing device of claim 1 wherein there are two upper cables and two lower cables.

3. The chimney reinforcing device of claim 1 wherein each of said angle irons have cable supporting members at external corners of the angle irons where they intersect the cables to facilitate the installation of the chimney reinforcing device.

4. The chimney reinforcing device of claim 3 wherein the cable supporting members comprise notches formed in the corners.

5. The chimney reinforcing device of claim 1 wherein said lengths of angle iron have means for vertically supporting said lengths of angle iron before said cables have been secured around them.

6. The chimney reinforcing device of claim 5 wherein said means for vertically supporting comprise a horizontal plate secured across a top end of each angle iron.

7. A method of reinforcing a brick chimney against earthquake damage, said brick chimney being of the type which is built in the wall of a structure between first and second vertical studs and has a top, two external corners, two internal corners, a roof which intersects the two internal corners at a line of intersection and a chimney height above the roof line, said method comprising:

placing two shorter lengths of angle iron from near the top of the chimney around the two internal corners to near the line of intersection with the roof;

placing two longer lengths of angle iron from near the top of the chimney around the two external corners to a point of at least two feet below the line of intersection with the roof;

tightening at least one upper cable means around the two shorter lengths and the two longer lengths of angle iron;

affixing one end of a length of a lower cable means to said first vertical stud below said line of intersection;

affixing the other end of a length of a lower cable means to said second vertical stud below said line of intersection; and tightening said lower cable around said angle irons thereby supporting the upper end of the chimney with the lower length of the chimney.

* * * * *